US005805176A

United States Patent [19]

Saito et al.

[11] Patent Number: 5,805,176

[45] Date of Patent: Sep. 8, 1998

[54] INK JET PRINTER AND DEVICE FOR INSURING PROPER PRINTING

[75] Inventors: Kazuo Saito; Katsuhiko Iida; Kenichi Miyazaki, all of Nagano, Japan

[73] Assignee: Seiko Epson Corporation, Tokyo-to, Japan

[21] Appl. No.: 385,623

[22] Filed: Feb. 9, 1995

[30] Foreign Application Priority Data

Feb. 10, 1994 [JP] Japan ..... 6-037629
Feb. 28, 1994 [JP] Japan ..... 6-054984

[51] Int. Cl.[6] ..... B41J 25/308; B41J 2/01; B41J 11/20

[52] U.S. Cl. ..... 347/8; 347/104; 400/56

[58] Field of Search ..... 347/8, 104, 3, 347/34, 43; 400/642, 56, 58, 595; 271/248, 188; 399/397, 405; 346/134

[56] References Cited

U.S. PATENT DOCUMENTS

| | | | |
|---|---|---|---|
| 4,767,114 | 8/1988 | Nishimoto | 271/3.2 |
| 4,933,726 | 6/1990 | Moriyama | 399/405 |
| 5,153,663 | 10/1992 | Bober et al. | 399/406 |
| 5,291,227 | 3/1994 | Suzuki | 347/8 |
| 5,393,151 | 2/1995 | Martin et al. | 347/104 |

FOREIGN PATENT DOCUMENTS

| | | | |
|---|---|---|---|
| 0 418 822 A2 | 9/1990 | European Pat. Off. | B41J 29/00 |
| 0 478 300A2 | 9/1991 | European Pat. Off. . | |
| 0472893 A1 | 3/1992 | European Pat. Off. . | |
| 0 526 239 A2 | 7/1992 | European Pat. Off. | B41J 2/01 |
| 0 556 045 A2 | 2/1993 | European Pat. Off. | B41J 13/00 |
| 0622227 A2 | 11/1994 | European Pat. Off. . | |
| 0 631 877 | 1/1995 | European Pat. Off. . | |
| 2 695 348A1 | 9/1993 | France . | |
| 55-91679A | 7/1980 | Japan . | |
| 3-128268 | 5/1991 | Japan . | |
| 4-341848A | 11/1992 | Japan . | |
| 2 271 084 | 9/1993 | United Kingdom | B41J 13/03 |
| 2 279 121 | 12/1994 | United Kingdom . | |

*Primary Examiner*—N. Le
*Assistant Examiner*—L. Anderson
*Attorney, Agent, or Firm*—Stroock & Stroock & Lavan LLP

[57] ABSTRACT

An ink jet printer having an ink jet head for ejecting ink onto a sheet of paper or the like during a printing operation is provided. A gap defining member is also provided in opposition to the ink jet head. The gap defining member has a planar portion which supports the sheet of paper or the like on its rear face, and thus defines the distance of the gap between the sheet of paper and the ink jet head. The gap defining member also has a plurality of ribs extending from the planar portion in the direction of the paper feed path. These ribs help to guide and to further support the sheet of paper or the like.

32 Claims, 14 Drawing Sheets

X
Y
Z
50
51
51a
51b
51c
51d
51e
51f
51s
52
52a
53
54
55
56
56a
57
58
90
91
92
94
95
96
96a
97
98

INK JET PRINTER AND DEVICE FOR INSURING PROPER PRINTING

BACKGROUND OF THE INVENTION

This invention relates generally to an ink jet printer, and more particularly to an ink jet printer in which a sheet of paper is supplied by a sheet supply roller and ink is ejected from an ink jet head onto the surface of the sheet of paper during a print operation.

In a proposed ink jet printer such as that shown in FIG. 15, a sheet of paper P is supplied to and wound on a sheet supply roller 1. An ink jet head 2 ejects ink while reciprocating in a direction perpendicular to the plane of FIG. 15 across the face of sheet P. Thus, a print operation is performed on the surface of sheet P as it is incrementally supplied from sheet supply roller 1. A designates a printing region accessible to ink jet head 2. A sheet guide 3 has a guide face 3*a* extending in a direction perpendicular to the plane of FIG. 15. Guide face 3*a* comprises a horizontal face and supports the back of sheet P so as to define the width of a gap between ink jet head 2 and sheet P. A sheet discharge roller 4 discharges sheet P after it is printed upon. In this proposed printer, an undesired ink ejection (referred to as an "idle ejection") may occur in which ink is ejected from ink jet head 2 when no sheet P is present in printing region A. The ejected ink is blocked by sheet guide 3 so that a sheet which subsequently reaches sheet supply roller 1 is not stained with ink. Specifically, since guide face 3*a* extends horizontally, ink impinged on guide face 3*a* is prevented from dripping onto sheet supply roller 1, and is therefore prevented from smearing on sheet P. Ink deposited on guide face 3*a* is solidified by drying before the next sheet P is fed.

An idle ejection is caused when, after a sheet detection sensor (not shown) located before ink jet head 2 in the paper feed path detects sheet P, a sheet supply failure or the like occurs so that sheet P fails to reach printing region A. Once the sheet detection sensor detects a sheet, ink jet head 2 operates on the assumption that sheet P will arrive in printing region A a prescribed period thereafter. Therefore, if a jam occurs and sheet P does not reach region A, ink jet head 2 will eject ink onto sheet guide 3.

FIG. 16 shows a conventional ink jet printer disclosed in Unexamined Japanese Patent Publication (Kokai) No. Hei. 3-128268. A sheet of paper P is wound on a sheet supply roller 1'. An ink jet head 2' ejects ink from nozzles 2*a'* while reciprocating in a direction perpendicular to the plane of FIG. 16. A print operation is performed on a surface Pa of sheet P which is supplied from sheet supply roller 1'. A gap defining member 3' has a defining face 3*c'* extending in a direction perpendicular to the plane of FIG. 16. Defining face 3*c'* is a flat face and supports the back face Pb of sheet P so as to define the distance of the gap between ink jet head 2 and sheet P.

FIGS. 17 and 18 depict another conventional ink jet printer disclosed in U.S. Pat. No. 5,291,227. A printing region Par, where ink ejected from an ink jet head 5 is deposited on a sheet P during a print operation, is provided in a paper feed path. Paper feed path 3 is substantially planar so that sheet P is accurately conveyed irrespective of the thickness of the sheet and a print operation is performed at a predetermined position. Sheet front edge guide members 6 each having a guide surface 6*a* are disposed between sheet supply rollers 8 and sheet discharge rollers 9. Guide surfaces 6*a* are separated by a gap S from sheet P which is sandwiched between sheet supply rollers 8 and also between sheet discharge rollers 9. Guide surfaces 6*a* are formed so that the gap S between guide surfaces 6*a* and sheet P gradually decreases in the downstream direction of paper feed path 3. If ink is deposited on guide surfaces 6*a*, sheet P is prevented from being stained with ink. As shown in FIG. 18, each of guide members 6 is formed as a rib, and an ink absorbing member 7 is disposed under each of guide members 6.

However, the above-mentioned ink jet printers have generally suffered from the following problems:

Problem 1

In the ink jet printer as shown in FIG. 15, the front edge of sheet P may not be delivered to ink jet head 2 at the proper angle. This angle is determined by sheet supply roller 1 and pinch roller 1*a*. Thus, sheet P may not be properly guided by sheet guide 3.

When the front edge of sheet P is supplied at an angle which is more downward than required, as indicated by arrow P' in FIG. 15, the front edge of sheet P may come into contact with front end 3*b* of sheet guide 3 so that a paper feed jam may occur. This contact with front end 3*b* may occur if sheet P is caused to spontaneously curl by moisture or the like, or if sheet P which is originally flat is caused to curl during the winding of sheet P on sheet supply roller 1.

In order to remedy this situation, the following measures have been employed in the conventional art.

First, a plurality of short rollers have been used in place of sheet supply roller 1. Front end 3*b* of sheet guide 3 is then located between the short rollers so as to accurately guide the front edge of sheet P. However, when this plurality of short rollers are used in place of sheet supply roller 1, sheet P may not be accurately guided or supplied.

Second, guide face 3*a* has been inclined as indicated by dotted line 3*a'* in FIG. 15, so that the front edge of sheet P is accurately guided and scooped up by guide face 3*a*. However, ink which has been deposited on guide face 3*a* during an idle ejection may drip along inclined face 3*a'* and stain or smear on sheet supply roller 1 and other parts.

These problems also occur with the conventional ink jet printer of FIG. 16. In the ink jet printer of FIG. 16, the front edge of sheet P which is to be printed upon after being wound on sheet supply roller 1' may contact lower end 3*b'* of gap defining member 3'. Furthermore, ink which has been deposited on defining face 3*c* during an idle ejection may drip from lower end 3*b'* and stain sheet supply roller 1' and other parts.

Problem 2

In all of the above-mentioned conventional ink jet printers, when high density printing is performed, or when ink dots are formed on sheet P in a high density, water in the ink may cause the sheet to warp. The warped sheet may contact and rub against ink jet head 2, resulting in a stain on sheet P. When color printing is performed, a plurality of colored ink dots are formed on existing ink color dots. The degree of warping of sheet P due to water in the ink is increased so that the sheet may easily come into contact with ink jet head 2.

SUMMARY OF THE INVENTION

An ink jet printer having an ink jet head for ejecting ink onto a sheet of paper or the like during a printing operation is provided. A gap defining member is also provided in opposition to the ink jet head. The gap defining member has a planar portion which supports the sheet of paper or the like on its rear face, and thus defines the distance of the gap between the sheet of paper and the ink jet head. The gap defining member also has a plurality of ribs extending from the planar portion in the direction of the paper feed path.

These ribs help to guide and to further support the sheet of paper or the like. To further aid in guiding and supporting the sheet of paper, the ribs are given a substantially trapezoidal shape.

In an alternative embodiment, the sheet supply roller is rotated at a first speed. Conveying rollers are rotated at a speed slightly greater than the speed of the sheet supply roller. These rollers convey the sheet of paper from the sheet supply roller. The ink jet head is disposed between the sheet supply roller and the conveying rollers. The sheet of paper is held taut between the rollers. A gap defining member is disposed between the sheet supply roller and the conveying rollers in opposition to the ink jet head. This gap defining member accurately defines the distance of the gap between the ink jet head and the sheet of paper to improve print quality. The gap defining member may be formed with a plurality of ribs formed in a direction parallel to the paper feed path. In this manner, if the sheet of paper is warped from the ink during printing, an accurate gap can still be maintained.

In addition, the conveying rollers may be formed as a plurality of roller pairs, and intermediate serrated rollers may be provided between these pairs. The intermediate serrated rollers are suspended from elastic members, and push down on the sheet of paper between the pairs of conveying rollers. Thus, the sheet of paper is urged further from the ink jet head.

Accordingly, it is an object of the present invention to provide an ink jet printer which accurately guides the front edge of a sheet of paper.

Another object of the present invention is to provide an ink jet printer in which, if an idle ink ejection occurs a sheet supply roller and other parts are prevented from being stained with ink.

Yet another object of the present invention is to provide an ink jet printer which allows a high-density printing operation to be performed in which if a sheet is warped by water in the ink, the sheet is prevented from coming into contact with the print head.

Still other objects and advantages of the invention will in part be obvious and will in part be apparent from the specification and drawings.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is made to the following description taken in connection with the accompanying drawings, in which:

FIG. 6(*b*) is a left side elevational view showing a gap defining member of the ink jet printer of FIG. 1;

FIG. 6(*c*) is a right side elevational view showing a gap defining member of the ink jet printer of FIG. 1;

FIG. 7(*b*) is a perspective view of an intermediate serrated roller of the present invention with its shaft elastically defined;

FIG. 8(*b*) is a schematic front elevational view illustrating the operation of the ink jet printer without ribs but with an enlarged gap;

FIG. 8(*c*) is a schematic front elevational view illustrating the operation of the ink jet printer of the present invention;

FIG. 9(*b*) is a schematic front elevational view illustrating the operation of preferred narrow rollers of the ink jet printer of the present invention;

FIG. 10(*b*) is a schematic front elevational view illustrating the malfunction of the intermediate serrated rollers of the ink jet printer of the present invention when opposed to rollers;

FIG. 10(*c*) is a schematic front elevational view illustrating the malfunction of the intermediate serrated rollers of the ink jet printer of the present invention when too many are present;

FIG. 10(*d*) is a schematic front elevational view illustrating the malfunction where the intermediate serrated rollers of the ink jet printer of the present invention are not used.

FIG. 11(*b*) is a schematic side elevational view illustrating the operation of the ribs of the ink jet printer of the present invention;

FIG. 12(*b*) is a schematic side elevational view illustrating the operation of the ribs of the ink jet printer of the present invention;

FIG. 13(*b*) is a schematic side elevational view illustrating the operation of an alternative form of the ribs of the ink jet printer of the present invention;

DETAILED DESCRIPTION OF PREFERRED EMBODIMENTS

Figure 1:
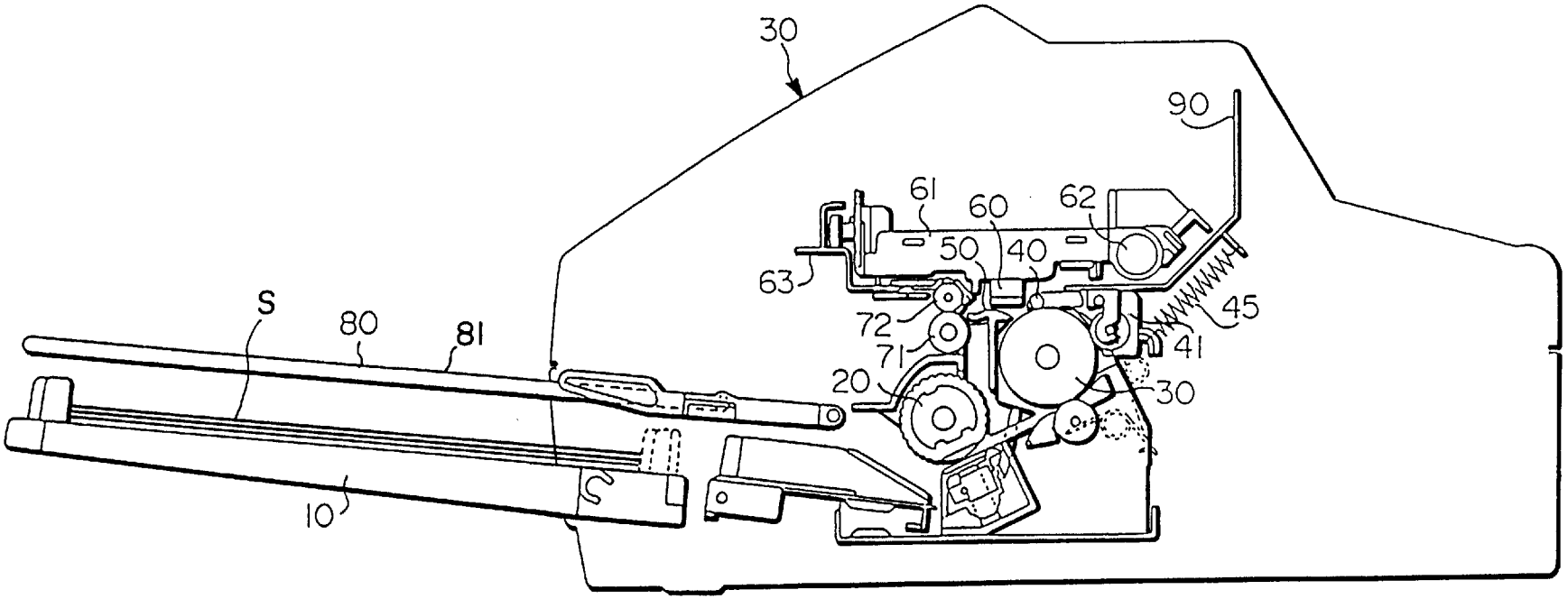
FIG. 1 is a side elevational view showing the internal structure of a first embodiment of an ink jet printer of the present invention.

Referring first to FIG. 1, a number of sheets which are to be printed upon are stacked on a sheet feed tray 10. A sheet feed roller 20 is also provided which feeds the sheets one by one from sheet feed tray 10.

Figure 3:
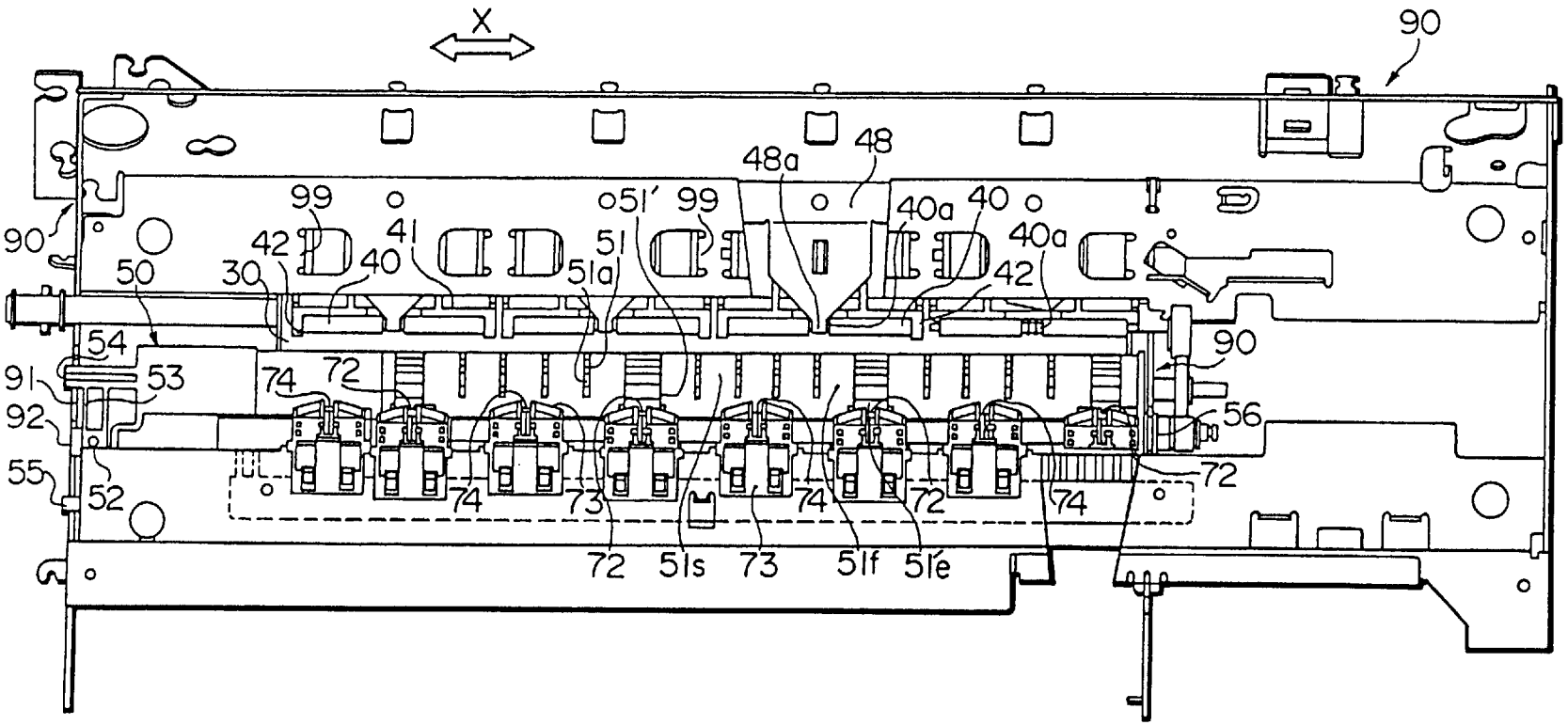
FIG. 3 is a partial enlarged plan view of the ink jet printer of FIG. 1 with portions removed.
Figure 4:
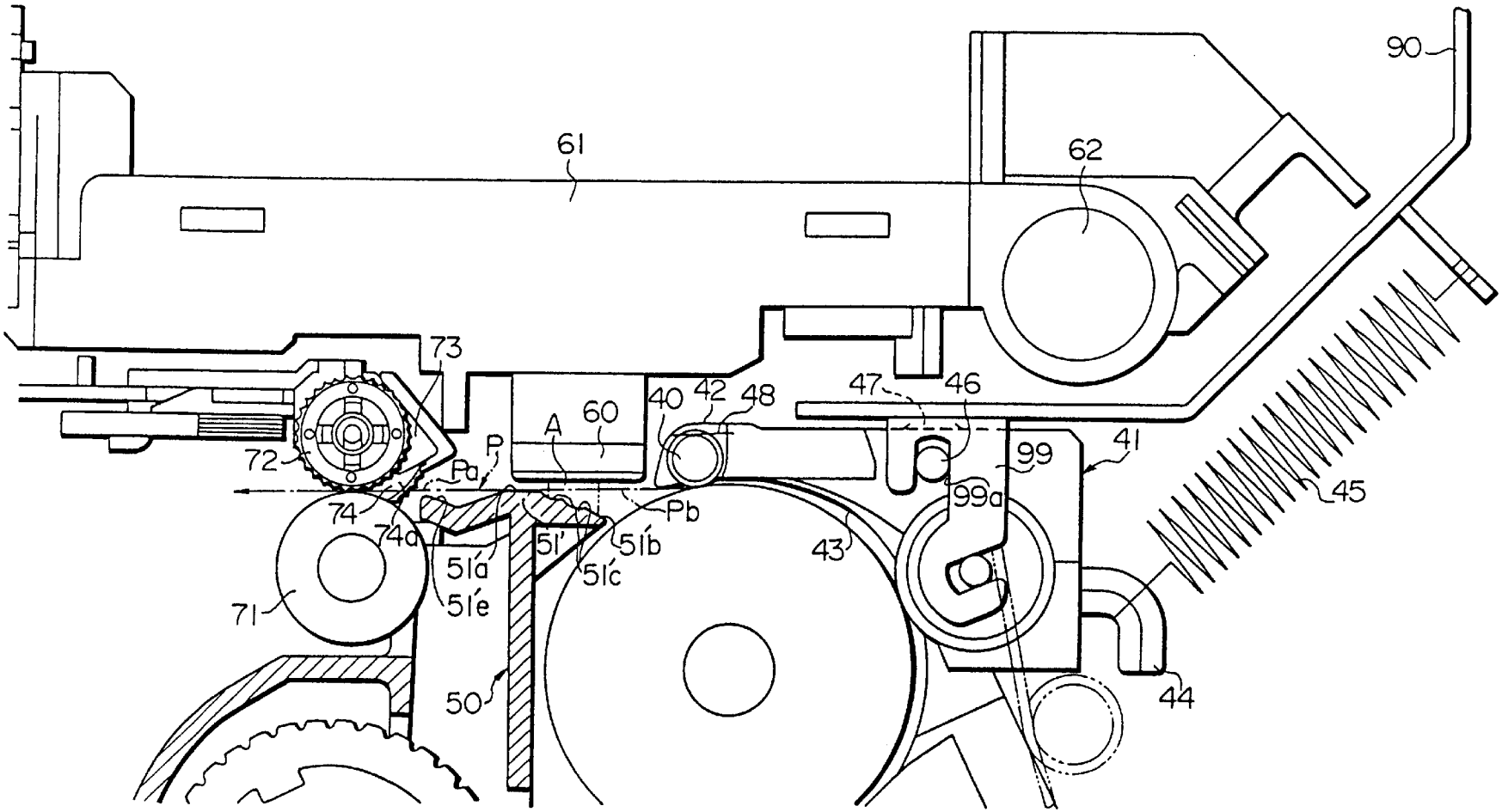
FIG. 4 is a partial enlarged cross-sectional view of the ink jet printer of FIG. 1 taken along lines IV—IV of FIG. 2.

A sheet P which has been fed by sheet feed roller 20 is wound on a sheet supply roller 30 to be inverted, and is then delivered from sheet supply roller 30. The delivery angle of sheet P is defined by pinch rollers 40. First, the front edge of supplied sheet P is guided by a gap defining member 50, which also serves as a guide member. As shown in FIGS. 3 and 4, the back face Pb of sheet P is guided while in contact with uppermost faces 51*a* of ribs 51 which are formed on the upper face of gap defining member 50, thereby defining the distance of a gap between sheet P and an ink jet head 60. Ink is ejected from ink jet head 60 onto the upper surface Pa of sheet P in order to print thereon. Sheet P which has been printed upon is then discharged onto a sheet discharge tray 80 through a plurality of pairs of sheet discharge rollers 71 and 72 which constitute conveyor rollers. Upon discharge the front edge of sheet P contacts an upper face 81 of sheet discharge tray 80.

Gap defining member 50 is disposed adjacent sheet P which is conveyed by sheet supply roller 30, and sheet discharge rollers 71 and 72. As shown in FIGS. 3 to 6, gap defining member 50 has a horizontal portion 51*f* constituting a planar face portion, and ribs 51 which are formed integral with, and project from, horizontal portion 51*f*. A plurality of ribs 51 are spaced in a direction perpendicular to the direction of the paper feed path of sheet P. As shown in FIG. 3, four ribs 51' are formed with a larger width and twelve ribs 51 are formed with a smaller width. Sixteen ribs are formed in total. In the specification, "ribs 51" includes ribs 51' unless otherwise denoted.

Figure 5:
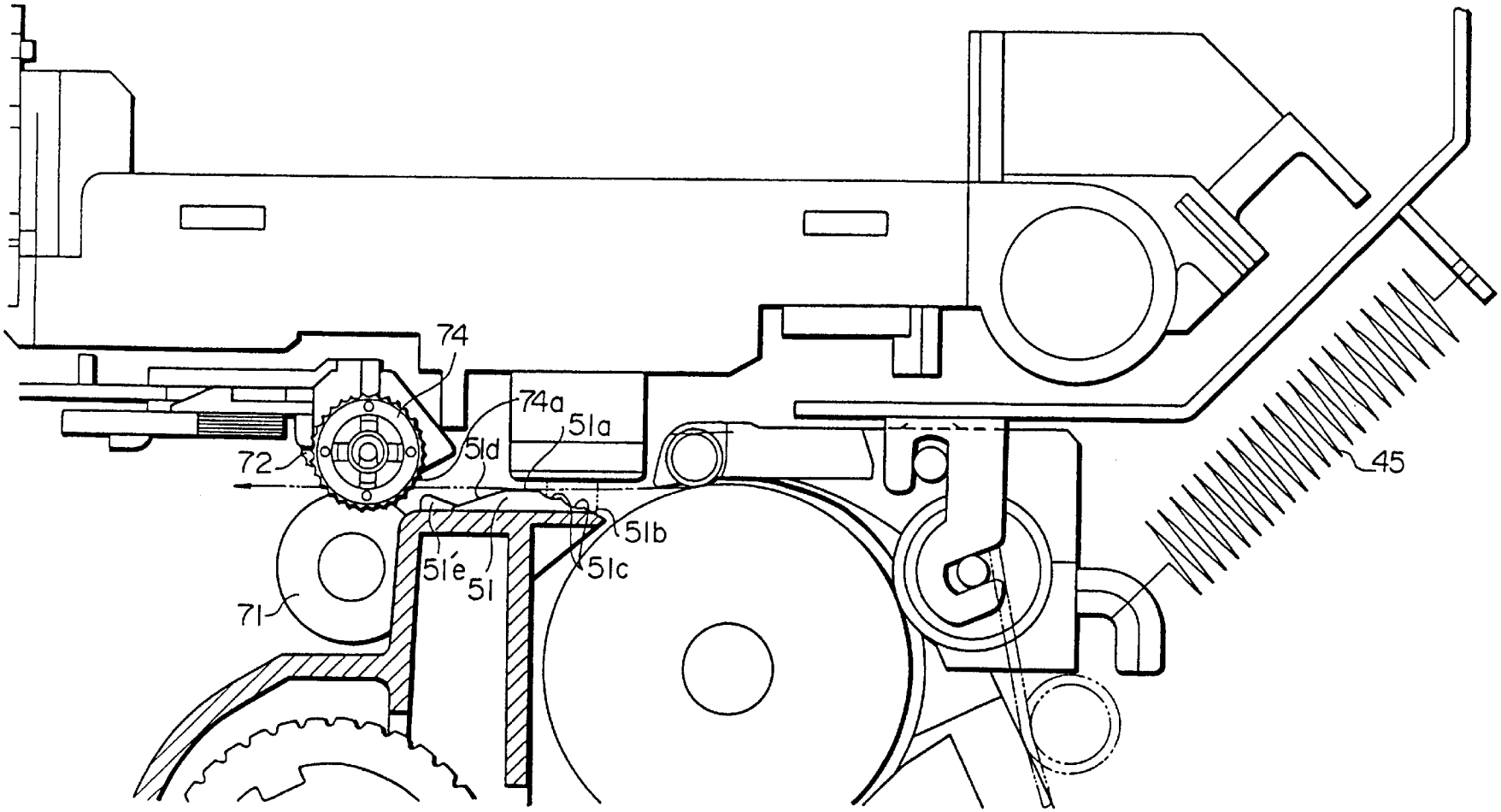
FIG. 5 is a partial enlarged cross-sectional view of the ink jet printer of FIG. 1 taken along lines V—V of FIG. 2.

Referring now to FIGS. 4 and 5, each of ribs 51 has a substantially trapezoidal shape in side view which includes an inclined face 51*b*, an uppermost face 51*a* continuing from inclined face 51*b*, and a downward inclined face 51*d* continuing from uppermost face 51*a* which extends along the sheet conveying direction. Two ink reservoir grooves 51*c* are formed on inclined face 51*b*.

Inclined face 51*b* scoops up the front edge of sheet P while guiding the front edge of sheet P which is supplied by sheet supply roller 30. Uppermost face 51*a* contacts back face Pb of sheet P to define the distance of the gap between ink jet head 60 and sheet P.

Figures 6A, 6B, 6C:
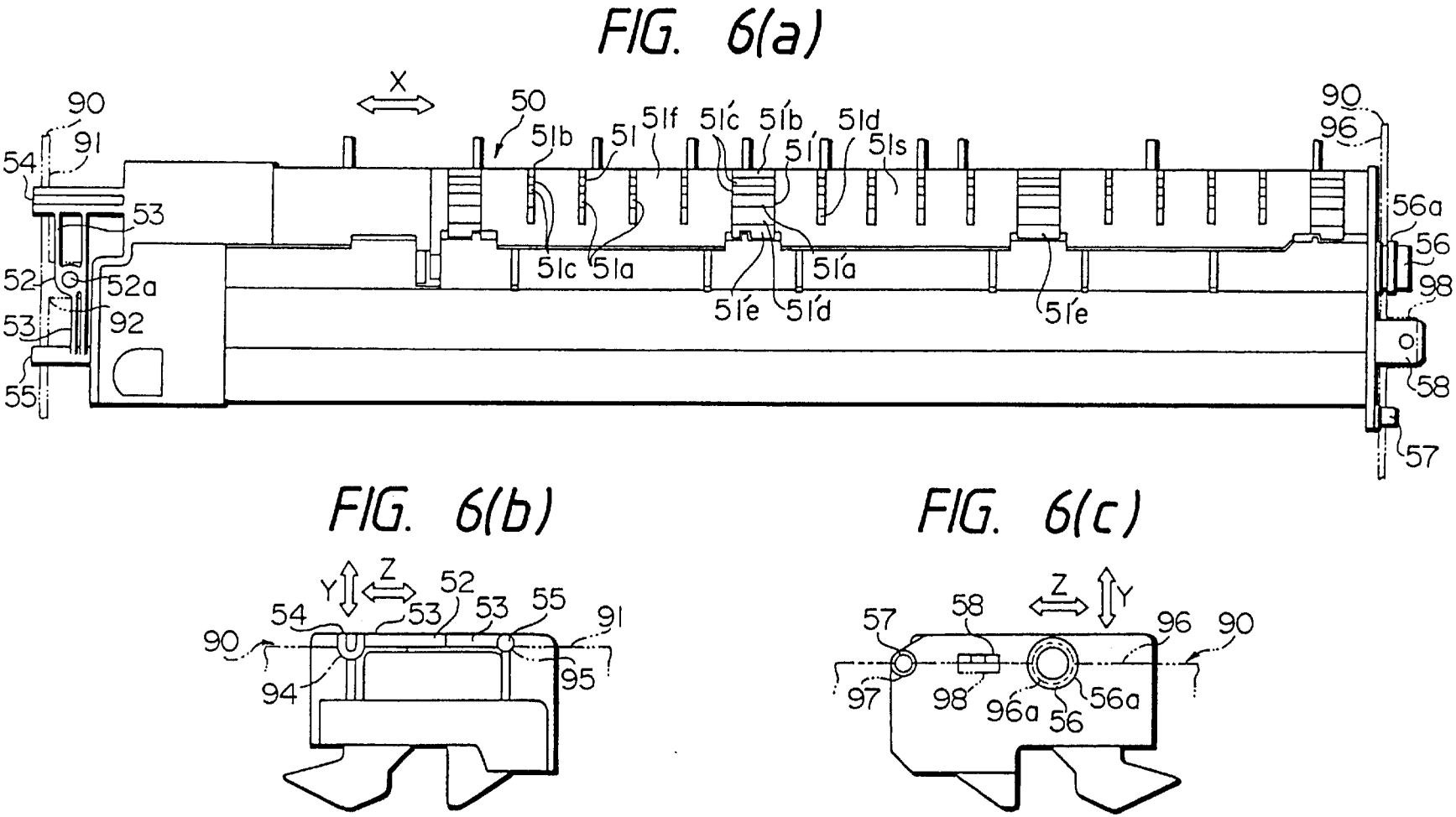
FIG. 6(*a*) is a partial enlarged plan view showing a gap defining member of the ink jet printer of FIG. 1.

Guide portions 51'*e* which guide the front edge of sheet P toward sheet discharge rollers 71 and 72 are disposed between sheet discharge rollers 71 and 72 and ribs 51 in the paper feed path. Guide portions 51'*e* are disposed only in the vicinity of discharge rollers 71 and 72 and not in other places along the width of the paper feed path. As shown in FIGS. 6(*a*), 6(*b*) and 6(*c*), a fixing portion 52, and positioning portions 54 and 55 are formed at the left end of gap defining member 50. Fixing portion 52 is integrated with positioning portions 54 and 55 through flexible portions 53. Positioning portion 54 has a rod-like shape having a U-shaped section. Positioning portion 55 is formed with a round rod-like shape. Semicircular recesses 94 and 95, which are adapted to receive the lower portions of positioning portions 54 and 55, are formed on an upper edge 91 of a frame 90. Positioning portions 54 and 55 are closely fitted into recesses 94 and 95, respectively, so that gap defining member 50 is positioned with respect to frame 90 in the Y and Z directions (see FIG. 6(*b*)). Fixing portion 52 has a substantially disk-like shape. A tapped hole 52*a* is formed at the center of fixing portion 52. Flexible portions 53 consist of four plate-spring like members which are located at a height substantially equal to that of fixing portion 52. A mounting portion 92 is formed at a position confronting fixing portion 52 by partly deforming frame 90.

As shown in the figures, since gap defining member 50 is a long member, when the temperature changes, gap defining member 50 expands or contracts in the longitudinal direction (direction of arrow X of FIG. 6(*a*)). In order for the expansion and contraction to be absorbed by flexible portions 53, flexible portions 53 are formed to extend in the Z direction which is perpendicular to the direction of expansion and contraction of gap defining member 50.

As shown in FIGS. 6(*a*) and 6(*c*), a flanged positioning portion 56, a pin-like positioning portion 57, and a fixing piece 58, which is fixed to frame 90, are formed at the second end of gap defining member 50. On the other upper edge 96 of frame 90, semicircular recess 96*a* is formed into which flanged positioning portion 56 is fitted. The periphery of flanged positioning portion 56 is then sandwiched by flanges 56*a*, a semicircular recess 97 into which the pin-like positioning portion 57 is fitted, and a mounting portion 98 which is fixed to fixing piece 58. Positioning portions 56 and 57 are closely fitted into recesses 96*a* and 97, respectively, so that gap defining member 50 is positioned with respect to frame 90 in the X, Y and Z directions (see FIGS. 6(*a*) and 6(*c*)).

Gap defining member 50 is mounted on frame 90 in the Y direction. Positioning portions 54 and 55 are fitted into recesses 94 and 95 of frame 90, and positioning portions 56 and 57 are fitted into recesses 96*a* and 97 of frame 90. Thereafter, fixing portions 52 and 58 are fixed to mounting portions 92 and 98, thereby fixing gap defining member 50 to frame 90.

Fixing portion 52 is integrated with the positioning portions 54 and 55 through flexible portions 53. Since fixing portion 52 is firmly fixed to frame 90, when a temperature change causes gap defining member 50 to expand or contract in the X direction, the expansion or contraction is absorbed by the elastic deformation of flexible portions 53 which are disposed between gap defining member 50 and fixing portion 52. Thus, deformation or warping of gap defining member 50 in the Y direction is prevented. Consequently, the front edge of sheet P can be accurately guided by inclined faces 51*b* of ribs 51, and the distance of the gap between sheet P and head 60 can be accurately defined.

Figure 2:
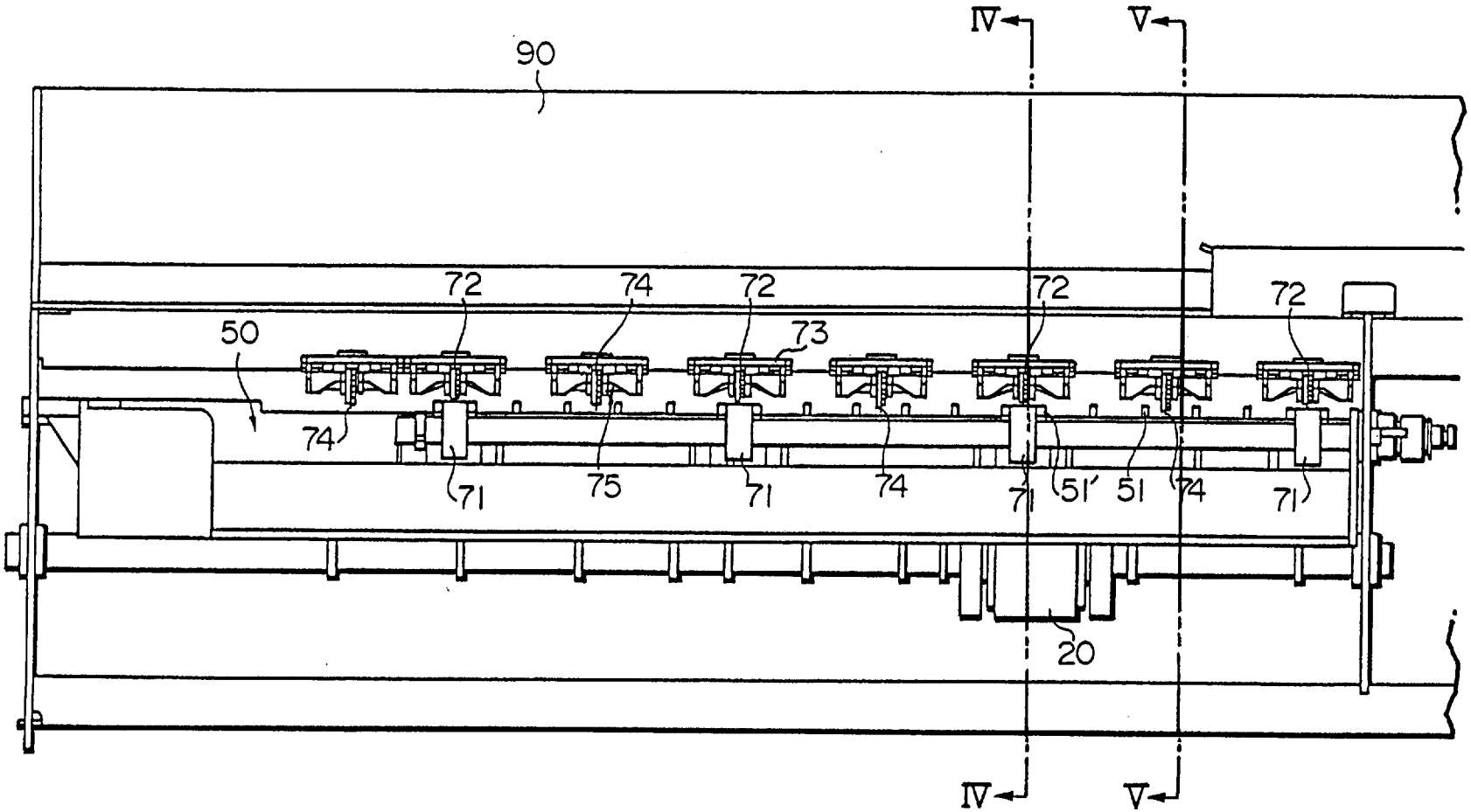
FIG. 2 is a partial enlarged front elevational view of the ink jet printer of FIG. 1.

As shown in FIG. 2, a plurality of pairs of sheet discharge rollers 71 and 72 (in the illustrated embodiment, four pairs) are arranged in the sheet width direction. Each pair of sheet discharge rollers 71 and 72 is comprised of a first rubber roller 71 which is rotated by a driving mechanism (not shown), and a second serrated or knurled roller 72 which is held in contact with roller 71 and is driven thereby to rotate. Holder 73 fixes serrated roller 72 to a guide rail 63. The peripheral speed of each pair of sheet discharge rollers 71 and 72, i.e., is slightly greater than the sheet supplying speed of sheet supply roller 30. Consequently, sheet P is conveyed under tension between sheet supply roller 30 and each pair of sheet discharge rollers 71 and 72.

Uppermost faces 51*a* of ribs 51 of gap defining member 50 are located slightly closer to the ink jet head 60 than the pass of the sheet assuming that there are no ribs 51. Thus, uppermost faces 51*a* contact back face Pb of sheet P while urging sheet P toward ink jet head 60. Thus, while sheet P is fed, the front and rear portions thereof are pulled down against gap defining member 50 by sheet supply roller 30, pinch rollers 40, and each of the pairs of sheet discharge rollers 71 and 72, whereby back face Pb of sheet P is accurately guided by uppermost faces 51*a* of ribs 51.

As shown in FIGS. 2 and 3, intermediate serrated rollers 74 are disposed between each of the pairs of sheet discharge rollers 71 and 72, and to the left of the left most pair of sheet discharge rollers 71 and 72 in the paper width direction as shown in FIG. 2. Intermediate serrated rollers 74 are located at positions which are closer to ink jet head 60 and extend further than serrated rollers 72. These intermediate serrated rollers 74 bend sheet P, which is elongated or swollen as a result of the absorption of ink, to a level lower than the contacting position of the pairs of sheet discharge rollers 71 and 72. Thus sheet P is prevented from contacting ink jet head 60.

Figure 7A:
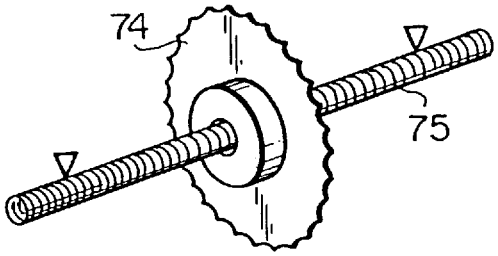
FIG. 7(*a*) is a perspective view of an intermediate serrated roller of the present invention.
Figure 7B:
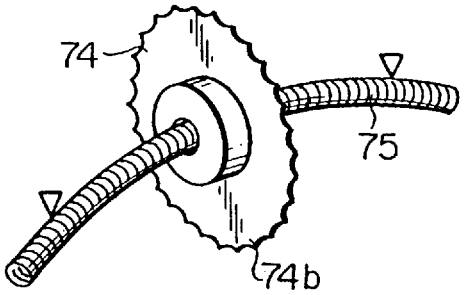

As shown in FIGS. 4 and 5, the outer periphery of each intermediate serrated roller 74 has a portion 74*a* which is closer to ink jet head 60 in the paper feed path than the contacting position of each of the pairs of sheet discharge rollers 71 and 72. The front edge of sheet P is guided by intermediate serrated rollers 74 before being fed by the pairs of sheet discharge rollers 71 and 72. Thus, sheet P is prevented from contacting ink jet head 60. Intermediate serrated rollers 74 are elastically suspended from a plurality of respective holders 73 by a plurality of rod springs 75. Thus, when sheet P is thin or has a high water content due to a high density printing, intermediate serrated rollers 74 smoothly press down sheet P. However, when sheet P is thick or dry, intermediate serrated rollers 74 do not press the sheet and recede upward as shown in FIG. 7(*b*) so as not to impair the accuracy of the feeding of sheet P. In a preferred embodiment, the pressing force which is exerted on sheet P by each of the plurality of rod springs 75 for each intermediate serrated roller 74 is set to a maximum of approximately 11 g. This force corresponds to when the lower end 74*b* of intermediate serrated roller 74 contacts sheet P and is lifted to a level substantially equal to that of the contacting position of sheet discharge rollers 71 and 72.

As shown in FIG. 3, sheet supply roller 30 consists of one round rod-like rubber roller, and is rotated by a driving mechanism which is not shown. During printing, after ink jet head 60 has completed one line of printing, sheet supply roller 30 advances sheet P by a length corresponding to the line pitch.

Pinch rollers 40 consist of round rod-like metal rollers. Each end portion of each pinch roller 40 is rotatably supported by an arm portion 42 of a holder 41. As shown in FIG. 4, each holder 41 also serves as a sheet guide which guides sheet P along a curved face 43 opposing sheet supply roller 30. A hook 44 is disposed on the back of each holder 41, and a tension spring 45 extends between each hook 44 and frame 90. Each holder 41 has a shaft 46 disposed at each side thereof, and an arcuate projection piece 47 disposed at the center thereof. Shafts 46 are rotatably supported by grooves 99*a* of support pieces 99 formed on frame 90, and arcuate projection pieces 47 contact the lower face of frame 90.

Consequently, the self-aligning function performed by the urging force of tension springs 45 acting upon holders 41 causes pinch rollers 40 to contact sheet supply roller 30 so as to be rotated thereby. As shown in FIG. 3, grounding plates 48 are attached to frame 90. The front edge 48*a* of each grounding plate 48 contacts with an annular groove 40*a* which is formed in the center portion of the corresponding pinch roller 40, whereby pinch roller 40 is grounded.

As shown in FIG. 1, ink jet head 60 is attached to a carriage 61, and can eject ink of a plurality of colors to print in color. Carriage 61 is guided by a guide shaft 62 and guide rail 63, and is driven to reciprocate by a carriage motor (not shown), in a direction perpendicular to the plane of sheet P. Both an ink tank for monochromatic printing, and an ink tank for color printing (not shown) can be mounted concurrently on carriage 61.

The following benefits are obtained through the use of the ink jet printer of the present invention:

(i) Sheet P which is supplied by sheet supply roller 30 is guided so that the front edge of sheet P is scooped up by inclined face 51*b* of gap defining member 50. Also, back face Pb of sheet P contacts the uppermost faces 51*a* of ribs 51. Thus, the distance of the gap between sheet P and ink jet head 60 is accurately defined. Ink is therefore properly ejected from ink jet head 60 onto surface Pa of sheet P during printing.

The front edge of sheet P which is supplied by sheet supply roller 30 is scooped up by inclined face 51*b* and therefore accurately guided to ink jet head 60. Even if sheet P curls due to moisture or the like, or if the front edge of sheet P is directed downward with respect to the paper feed path after being wound on sheet supply roller 30, the front edge of sheet P is scooped up by inclined face 51*b* so that sheet P is accurately guided.

Accordingly, the structure described above is particularly effective when sheet supply roller 30 is a roller for supplying a sheet wound thereon. Since sheet supply roller 30 is not required to be divided into short rollers and can consist of a single long rod-like roller, it is possible to insure a stable sheet supply operation.

Ink reservoir grooves 51*c* are formed on inclined faces 51*b* of ribs 51. If an ejection of ink onto inclined face 51*b* occurs when the printer is idle, this ink is trapped in ink reservoir grooves 51*c* and is prevented from dripping down along inclined face 51*b*. Consequently, sheet supply roller 30, and the like are prevented from being smeared with ink.

(ii) The provision of ink reservoir grooves 51*c* allows inclined face 51*b* of rib 51 to be disposed at a position confronting ink jet head 60. This allows ink jet head 60 to be located as close to sheet supply roller 30 as possible, and accordingly, reduces the unprintable area at the rear end portion of sheet P.

Figure 15:
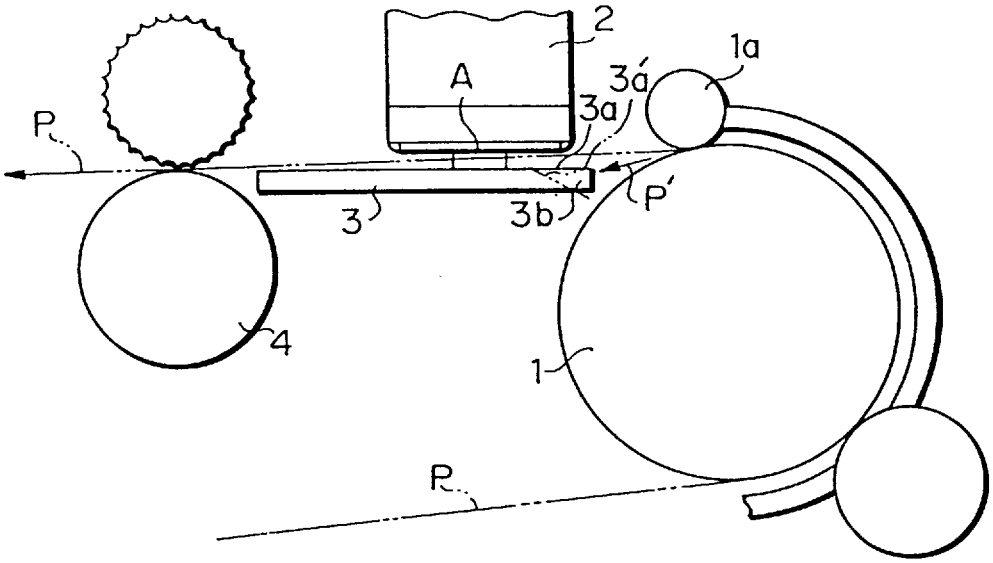
FIG. 15 is a side elevational view illustrating an embodiment of the proposed printer.
Figure 16:
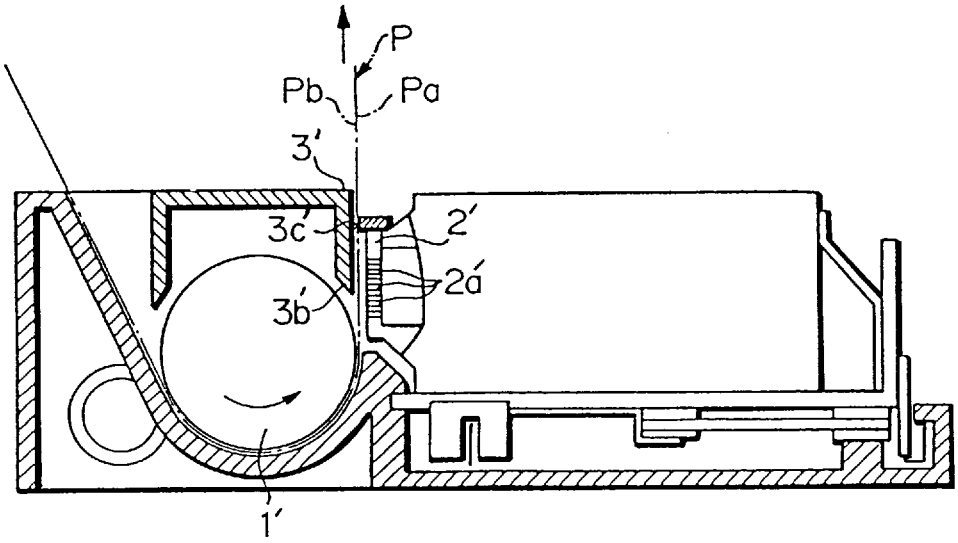
FIG. 16 PRIOR ART
FIG. 16 is a cross-sectional view illustrating an embodiment of the conventional printer.
Figure 17:
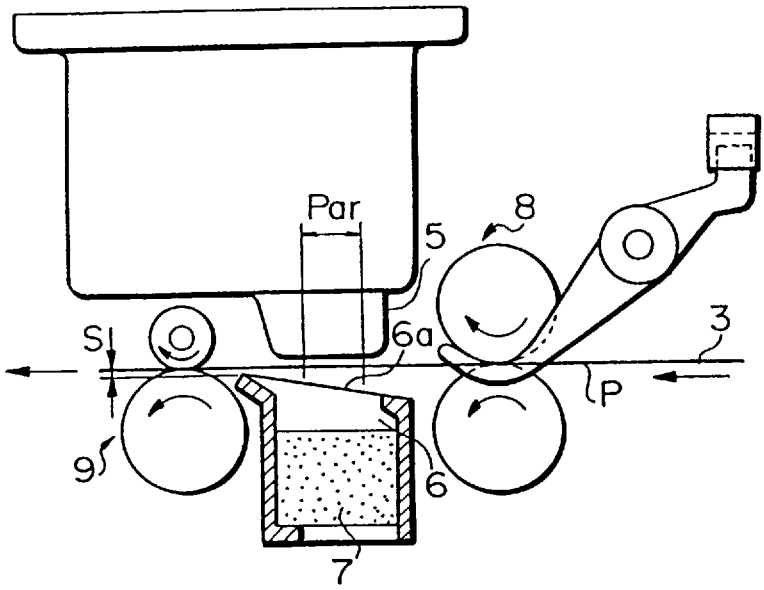
FIG. 17 PRIOR ART
FIG. 17 is a partially sectional view illustrating a second embodiment of the conventional printer.

More specifically, since inclined face 51*b* is a gentle slope, the front edge of sheet P can be guided more smoothly. However, as is shown in connection with the proposed printer of FIG. 15, when the incline of a face 3*a'* is made more gentle, inclined face 3*a'* may extend into the printing region A. Without any ink reservoir grooves, any ink ejected while the printer is supposed to be idle easily drips down inclined face 3*a'*. In order to allow inclined face 3*a'* to be sufficiently gentle to preclude ink from dripping down inclined face 3*a'*, an ink jet head 2 must be disposed at a position further to the left in FIG. 15 so that a printing operation is performed on the horizontal portion of a guide face 3. However, when ink jet head 2 is disposed in this left position, printing region A is situated further from a sheet supply roller 1 and pinch roller 1*a*. Thus, the unprintable area at the rear end portion of a sheet P' is enlarged. This is because once sheet P' is released from between sheet supply roller 1 and pinch roller 1*a*, the distance of the gap between the surface of sheet P and ink jet head 2 becomes unstable, and a desired print distance cannot be maintained.

In contrast, according to the ink jet printer of the present invention, ink reservoir grooves 51*c* allow inclined face 51*b* to be disposed at a position confronting ink jet head 60. Any ink ejected during an idle ejection will be retained by ink reservoir grooves 51*c*, and will thus keep the ink from dripping down inclined face 51*b*, and from staining sheet supply roller 30. This enables ink jet head 60 to be located as close to sheet supply roller 30 as possible. Thus, the size of the unprintable area at the rear end portion of sheet P' can be reduced.

(iii) Sheet P is printed upon while back face Pb of sheet P contacts ribs 51 of gap defining member 50 so that the distance of the gap between sheet P and ink jet head 60 is accurately maintained. Since ribs 51 extend in the direction of the paper feed path, they do not interfere with the feed of sheet P.

The plurality of ribs 51 are spaced in a direction perpendicular to the paper feed path. Even if ink dots are formed on sheet P in a high density, and water in the ink causes the sheet to warp, ribs 51 function so that the swollen portions of sheet P enter spaces 51s between ribs 51 as shown in FIG. 3. Thus, even if sheet P is warped by water in the ink, sheet P is prevented from coming into contact with, or rubbing against ink jet head 60. The operation of these spaces will be described in detail with reference to FIGS. 8(*a*) to 8(*c*) which are schematic front views illustrating the function of ribs 51 and spaces 51*s*.

Figure 8A:
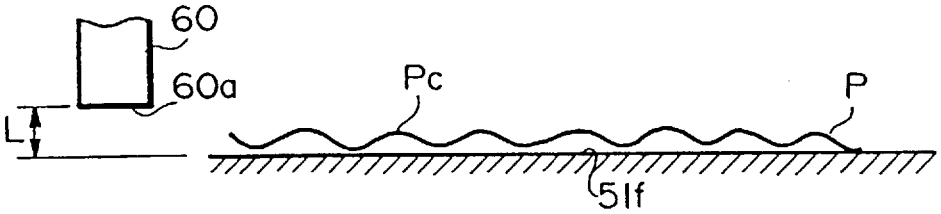
FIG. 8(*a*) is a schematic front elevational view illustrating the operation of an ink jet printer without ribs.
Figure 8B:
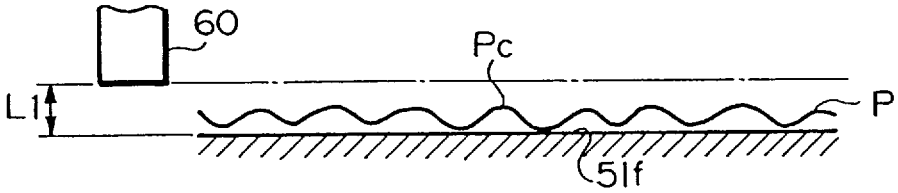
Figure 8C:
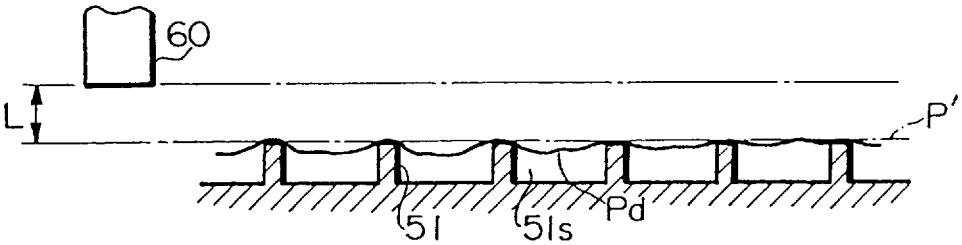

In FIG. 8(*a*), L designates and ideal gap between ink jet head 60 and sheet P when sheet P is not warped. If sheet P is warped by water in the ink, peaks Pc of warped sheet P may rub against an ink ejection face 60*a* of ink jet head 60. In order to solve this problem, it is possible to set a large gap L1 between ink jet head 60 and planar portion 51*f* as shown in FIG. 8(*b*). However, if this is done, when sheet P is not warped, the gap L1 between sheet P adjacent planar portion 51*f* and ink jet head 60 becomes too large. An ideal print state cannot be obtained since the distance between ink jet head 60 and sheet P on which an ink drop ejected from ink jet head 60 lands, is enlarged thereby increasing the deviation of the actual landing position from the ideal landing position.

In contrast, according to the present invention, sheet P is guided by ribs 51 as shown in FIG. 8(*c*). During a normal print operation in which the printing density is relatively low, or when a sheet is not warped, flat sheet P is guided by the upper faces of ribs 51 so that an ideal gap distance L is achieved between sheet P and ink jet head 60. If ink dots are formed on sheet P in a high density and water in the ink causes sheet P to warp, valley portions Pd of sheet P enter spaces 51*s* between the ribs 51 by gravity. Therefore, even if sheet P is warped, peaks Pc of sheet P are prevented from coming into contact with, and from rubbing against ink jet head 60.

Figure 9A:
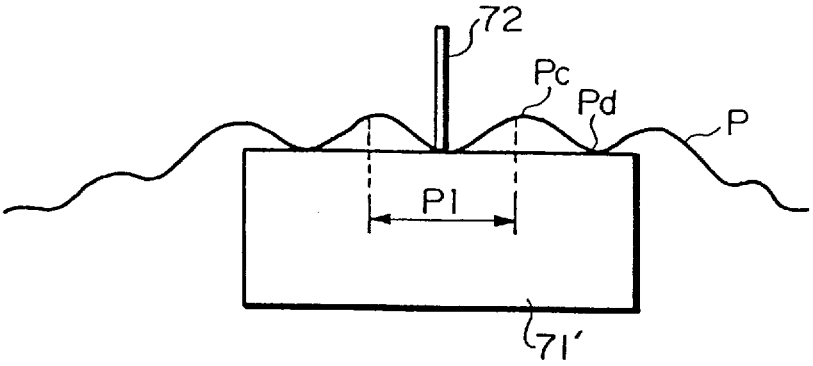
FIG. 9(*a*) is a schematic front elevational view illustrating the operation of relatively wide rollers of the ink jet printer of the present invention.
Figure 9B:
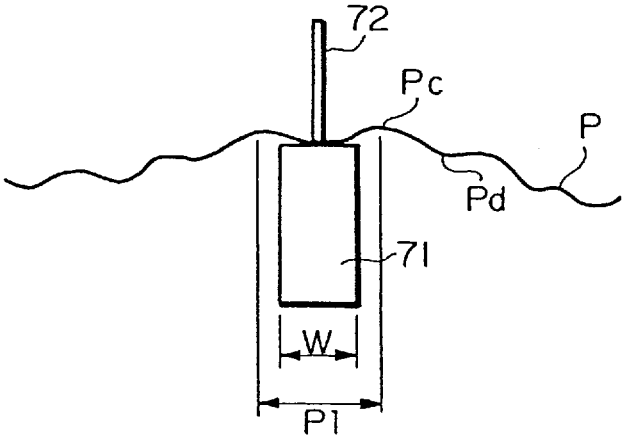
Figure 10A:
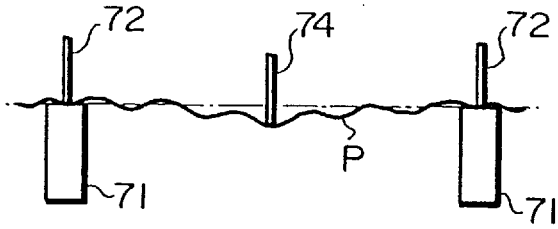
FIG. 10(*a*) is a schematic front elevational view illustrating the operation of the intermediate serrated rollers of the ink jet printer of the present invention.
Figure 10B:
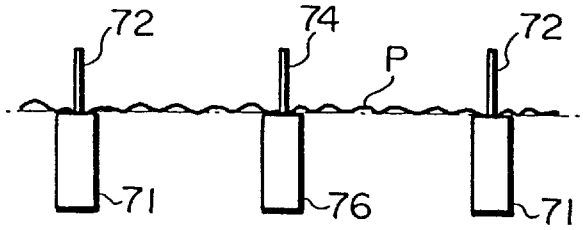
Figure 10C:
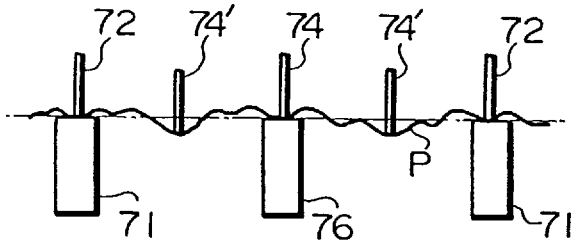
Figure 10D:
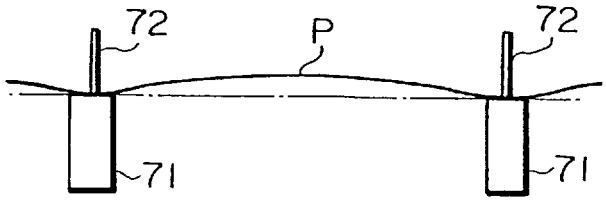

The plurality of rubber rollers 71 are disposed under sheet P not as a single long rod-like roller, but as a plurality of thin rollers which are arranged in the width direction of sheet P. This configuration allows valley portions Pd of sheet P which is warped by water in the ink, to sag more effectively. It is preferable to set the width of each rubber roller 71 to be as small as possible but within a range where the sheet conveying capacity of each rubber roller 71 is not impaired. If rubber rollers 71' are too wide, as shown in FIG. 9(*a*), the valley portions Pd of warped sheet P will be situated on roller 71. Thus, the peak Pc would be raised even if sheet P is pressed by serrated rollers 72.

As shown in FIG. 9(*b*), in order to avoid this problem rubber rollers 71 are formed so that their width W is smaller than the pitch P1 of the wave shape of the warped sheet. This configuration allows valley portions Pd of warped sheet P to properly sag between each rubber roller 71.

Figure 18:
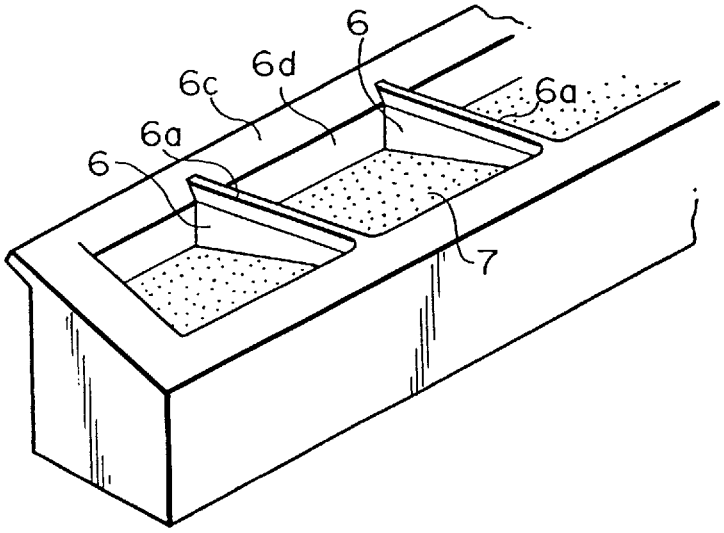
FIG. 18 PRIOR ART
FIG. 18 is a perspective fragmentary view illustrating the guide members of the prior art of FIG. 17.

As shown in FIG. 18, the conventional ink jet printer of U.S. Pat. No. 5,291,227 as described above has a plurality of ribs 6. However, ribs 6 do not project from the planar portion of a frame 6*c* but rather act as a bridge between the portions of frame 6*c*. If a sheet of paper is warped because of a high density printing, and the valley portions of the sheet enter the spaces between ribs 6, the front edge of the sheet may come in contact with an edge 6*d* of frame 6*c*, thereby causing a sheet supply failure.

In contrast, according to the ink jet printer of the present invention, ribs 51 project from planar portion 51*f* of gap defining member 50. Even if a sheet is warped and valley portions Pd of sheet P enter spaces 51*s* between ribs 51, the advancement of the front edge of sheet P is not impeded.

(iv) Sheet P is held under tension between sheet supply roller 30 and each of the pairs of sheet discharge rollers 71 and 72. When ink dots are formed on sheet P in a high density and sheet P is warped by water in the ink, the degree of warping of sheet P is reduced by the tension acting on sheet P. Since gap defining member 50 contacts back face Pb of sheet P while guiding sheet P toward ink jet head 60, the warped portions of sheet P are placed at positions which are relatively distant from ink jet head 60.

Therefore, even when a sheet is warped, sheet P is prevented from coming in contact with and from rubbing against ink jet head 60. As described above, the valley portions of sheet P enter spaces 51*s* between ribs 51, and warped sheet P is prevented from coming in contact with, and from rubbing against ink jet head 60.

The conveyor roller consists of the plurality of pairs of roller units 71 and 72 which are spaced in the width direction of the paper feed path. Intermediate serrated rollers 74, which urge sheet P away from ink jet head 60, are disposed between the plurality of pairs of roller units 71 and 72 on upper surface Pa of sheet P. As shown in FIG. 10(*a*), intermediate serrated rollers 74 further insure that sheet P does not come into contact with ink jet head 60 even if sheet P is warped.

Intermediate serrated rollers 74 are not provided in opposition to rubber rollers 71 of the plurality of discharge roller pairs 71 and 72 or in opposition to additional rubber rollers 76 as shown in FIG. 10(*b*). This is because if intermediate serrated rollers 74 were to be disposed as shown in FIG. 10(*b*), sheet P would be lifted to a level as high as the upper end of additional rubber rollers 76 and sheet P would not properly be support by ribs 51.

As shown in FIG. 10(*c*), if additional intermediate serrated rollers 74' are added to the configuration shown in FIG. 10(*b*), the gaps between the rubber rollers 71 and 76 are too small to allow sheet P to sag to a sufficient degree by gravity. Thus, sheet P would be lifted in the vicinity of rubber rollers 71 and additional rubber rollers 76.

In contrast, if no intermediate serrated rollers 74 are disposed between discharge roller pairs 71 and 72 as shown in FIG. 10(*d*), sheet P may be lifted as shown when the printing density is relatively low and the sheet is not warped or when an envelope is to be printed upon. Therefore, the gap between the pairs of sheet discharge rollers 71 and 72 is set so that sheet P, on which a high density print operation has been performed and which therefore has a high water content, will sag by gravity. Intermediate serrated rollers 74 are disposed to urge sheet P further away from ink jet head 60 than the contacting position between each pair of roller units 71 and 72.

As shown in FIG. 5, since the outer periphery of each intermediate serrated roller 74 has a portion 74*a* which is closer to ink jet head 60 than the contact position of the respective pair of sheet discharge rollers 71 and 72, the front edge of sheet P first contacts intermediate serrated roller 74 before contacting sheet discharge rollers 71 and 72. Therefore, sheet P is accurately guided between discharge rollers 71 and 72, and is further prevented from coming in contact with, and from rubbing against ink jet head 60. As shown in FIGS. 7(*a*) and 7(*b*), since each intermediate serrated roller 74 is supported by an elastic member 75, sheet P can be guided and urged away from ink jet head 60 more smoothly.

(v) The substantially trapezoidal shape of each rib 51 in side view produces the following benefits:

(a) In a serial printer which sequentially receives print data for each line from a host computer and conducts a printing in the unit of one line, or in other types of printers, a sheet of paper may need to be fed in the reverse direction. For example, if after printing a standard character, an enlarged character is to be printed on the next line and the top position of the enlarged character is located higher than the lower portion of the standard character printed in the previous line, the sheet is fed in the reverse direction, and the enlarged character is printed. The enlarged character is printed by a split printing operation, wherein the scanning of ink jet head 60 and the feeding of a sheet of paper by the length corresponding to the height of the printing region A shown in FIG. 4, are repeated plural times.

Figure 13A:
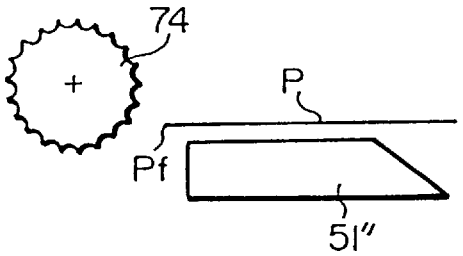
FIG. 13(*a*) is a schematic side elevational view illustrating the mulfunction of the ribs of the ink jet printer of the present invention if not in a trapezoidal shape.
Figure 13B:
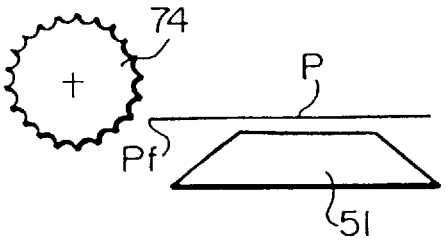

If an envelope or other sheet having a portion on its back face which may impede the reverse sheet conveyance (e.g., the flap of an envelope) is to be printed upon, and the ribs do not have a trapezoidal shape in side view but rather have a rectangular shape in a side view (see 51" of FIG. 13(*a*)), the portion may be caught on the ribs during the reverse conveying process. A pitch failure may occur in the reverse feeding distance and the feeding distance in the immediately subsequent forward feed will be incorrect. In contrast, according to the ink jet printer of the present invention, since ribs 51 have a substantially trapezoidal shape in side view, a flap of an envelope or the like will not be caught on ribs 51 even if the envelope or sheet is fed in the reverse direction. Thus, a pitch failure due to an improper feed is prevented.

Figure 11A:
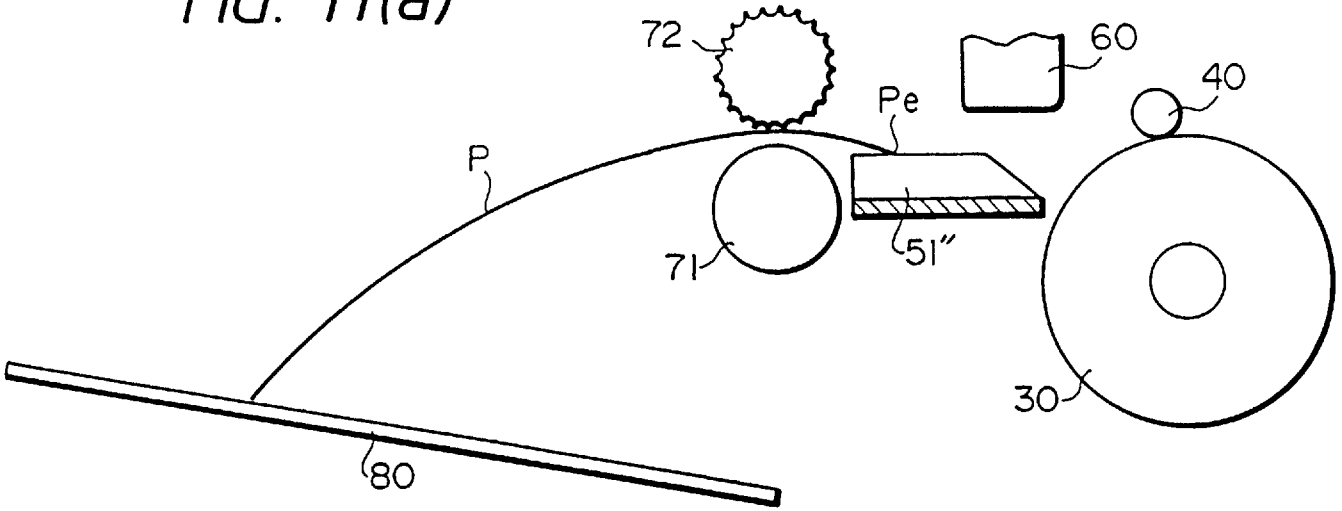
FIG. 11(*a*) is a schematic side elevational view illustrating the malfunction of the ribs of the ink jet printer of the present invention if not in a trapezoidal shape.
Figure 11B:
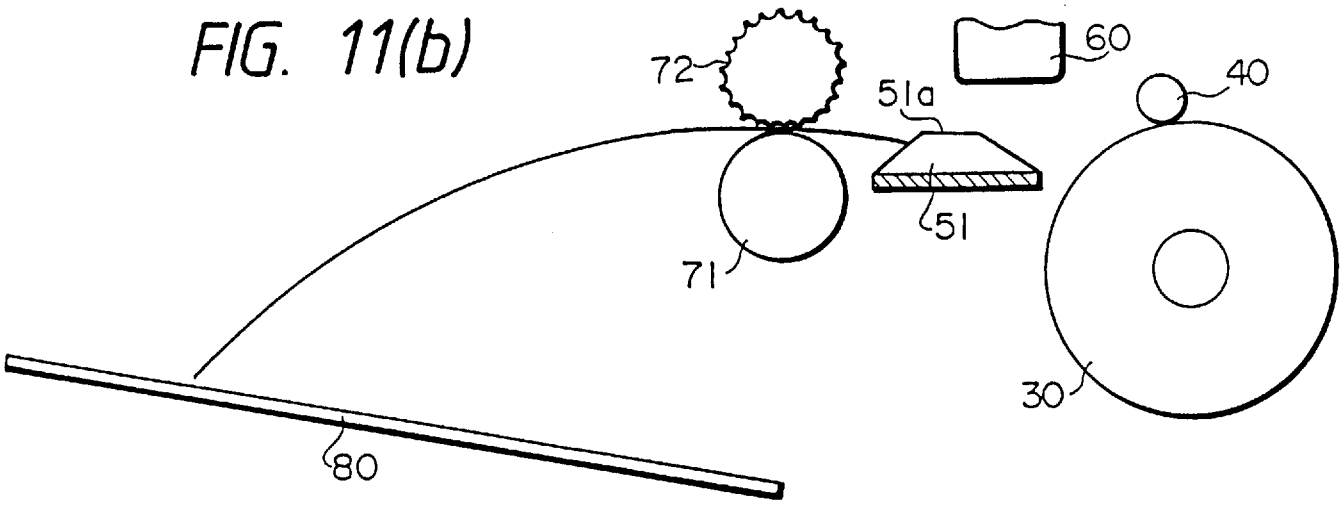

(b) If ribs 51" were to have the shape as shown in FIG. 11(*a*), and sheet P were formed of curled thick paper (e.g., a postcard), when sheet P was to be discharged from the printer the rear end Pe of sheet P would be supported by the upper faces of the ribs 51". Serrated rollers 72 of the discharge roller pairs may be lifted by sheet P and a sufficient sheet discharging force will not be imparted to sheet P from discharge rollers 71 and 72. Thus, a paper feed jam will occur.

In contrast, ribs 51 in the present invention have a trapezoidal shape in side view. As shown in FIG. 11(*b*), the rear edge Pe of curved sheet P quickly leaves uppermost faces 51*a* of ribs 51 so that serrated rollers 72 of discharge roller pairs 71 and 72 are not lifted by curved sheet P. Therefore, a sufficient sheet discharging force will be imparted to curved sheet P and no paper feed jam will occur.

Figure 12A:
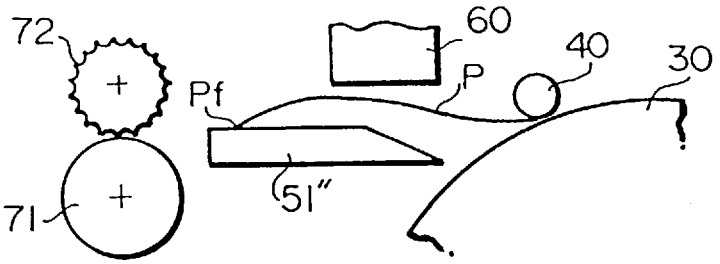
FIG. 12(*a*) is a schematic side elevational view illustrating the malfunction of the ribs of the ink jet printer of the present invention if not in a trapezoidal shape.
Figure 12B:
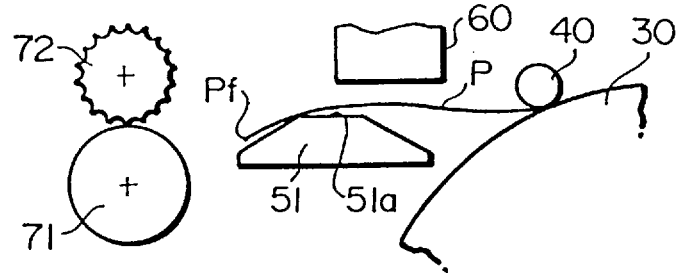

(c) If a printing operation is performed in the vicinity of a front edge Pf of sheet P as shown in FIG. 12(*a*), this portion of sheet P may be curled. If ribs 51" are shaped as shown in FIG. 12(*a*), front edge Pf of sheet P will be supported by the upper faces of ribs 51" until front edge Pf of sheet P reaches the plurality of pairs of sheet discharge rollers 71 and 72. This causes sheet P to be raised and contact with ink jet head 60 is more likely. In contrast, according to the present invention ribs 51 have a substantially trapezoidal shape in side view. Thus, front edge Pf of sheet P quickly leaves uppermost faces 51*a* as shown in FIG. 12(*b*). Sheet P is not raised, and is therefore is less likely to contact ink jet head 60.

(d) As described above, the present invention is provided with intermediate serrated rollers 74 for urging sheet P downward to a position which is lower than the position at which each of the pairs of roller units 71 and 72 contact each other.

If ribs 51" were to have the shape shown in FIG. 13(*a*), front edge Pf of sheet P would be forced against intermediate serrated rollers 74, in a perpendicular direction. This would cause a problem in the sheet supply operation and might cause a paper feed jam.

In contrast, ribs 51 of the present invention have a substantially trapezoidal shape in side view as shown in FIG. 13(*b*). Therefore, front edge Pf of sheet P easily meets intermediate serrated rollers 74. Sheet P may be bent slightly upon contact with intermediate serrated rollers 70 so that a smooth sheet supply operation is performed.

(vi) Guide portions 51'*e* which guide front edge Pe of sheet P toward the pairs of sheet discharge rollers 71 and 72 are disposed in the paper feed path between the pairs of sheet discharge rollers 71 and 72, and ribs 51. Ribs 51 have a substantially trapezoidal shape in side view. Therefore, front edge Pf of sheet P can be accurately guided toward the pairs of sheet discharge rollers 71 and 72. Guide portions 51*e* are disposed in the paper feed path only in opposition to the pairs of roller units 71 and 72, which constitute the conveyor rollers, and not in other places. Thus, front edge Pf of sheet P is accurately guided toward the pairs of sheet discharge rollers 71 and 72, and sheet P is prevented from coming in contact with or from rubbing against ink jet head 60.

Figure 14:
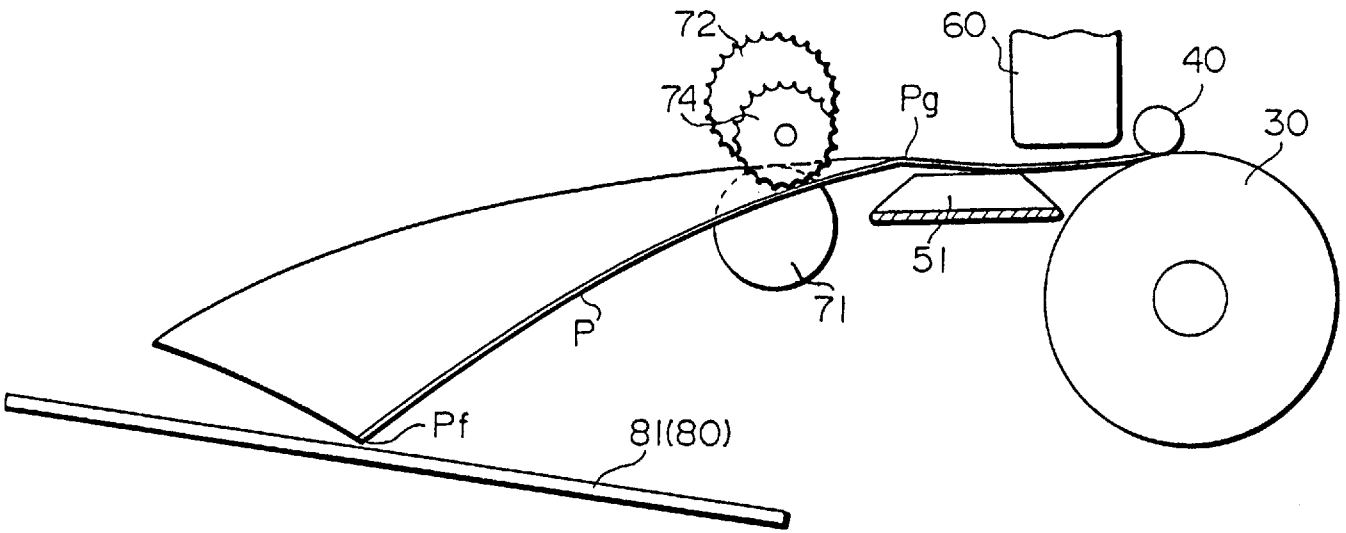
FIG. 14 is a schematic side elevational view illustrating the function of the intermediate serrated rollers and sheet discharge tray of the ink jet printer of the present invention.

(vii) The portion of sheet discharge tray 80 for receiving a discharged sheet P is inclined along a direction intersecting the paper feed path. When sheet P is discharged from the pairs of sheet discharge rollers 71 and 72, front edge Pf of sheet P sags by gravity as shown in FIG. 14. A bent portion Pg may be formed in sheet P upon contact with sheet discharge tray 80. This bent portion may cause the portion of sheet P which has not yet passed intermediate serrated rollers 74 to come into contact with ink jet head 60.

In the ink jet printer of the present invention, front edge Pf of sheet P is received by sheet discharge tray 80. A portion 81 of sheet discharge tray 80 which receives front edge Pf of sheet P is inclined at an angle to the paper feed path. Therefore, the bend of the above-mentioned bent portion Pg of sheet P is relaxed, and sheet P is prevented from coming in contact with ink jet head 60. Since intermediate serrated rollers 74 are closer to ink jet head 60 than the pairs of sheet discharge rollers 71 and 72, the bend angle of the above-mentioned bent portion Pg of sheet P is further relaxed. Thus, the maximum height of bent portion Pg is suppressed and sheet P is further prevented from coming into contact with ink jet head 60.

(viii) When a color printing operation is to be performed by ejecting a plurality of different colored ink dots from ink jet head 60, new ink dots are formed on existing ink dots, and thus the degree of warping of sheet P is particularly increased. However, warped sheet P is prevented from coming into contact with ink jet head 60 through the use of the present invention. Thus, the benefits are applicable also to multi-color printing.

While the printer in accordance with the invention is shown used in conjunction with a sheet of paper, other print mediums, such as envelopes or non-paper mediums, may be used.

It will thus be seen that the objects set forth above, and those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. An ink jet printer for imprinting onto a piece of printing medium, comprising:

a supply roller for supplying said piece of printing medium along a printing medium path;

an ink jet head disposed adjacent said supply roller for ejecting ink onto said piece of printing medium during a print operation;

a rib having an inclined surface disposed in opposition to said ink jet head for scooping up a front edge of said piece of printing medium supplied by said supply roller; and ink reservoir grooves disposed in said inclined surface for retaining any excess ink on said inclined surface.

2. The ink jet printer of claim 1 wherein said supply roller comprises a single roller extending across substantially the entire width of the printing medium path.

3. The ink jet printer of claim 1 wherein said supply roller supplies said piece of printing medium to said ink jet head.

4. The ink jet printer of claim 1 wherein said printing medium path extends from said supply roller past said ink jet head, said inclined surface being disposed in said printing medium path and closely adjacent said supply roller.

5. The ink jet printing of claim 1 wherein said piece of printing medium is a sheet of paper.

6. An ink jet printer head for imprinting onto a piece of printing medium having front and back faces displaced therepast along a printing medium path, comprising:

an ink jet head for ejecting ink onto said piece of printing medium during a print operation; and a gap defining member disposed in opposition to said ink jet head comprising:

a planar portion facing said ink jet head for defining a gap between said ink jet head and said piece of printing medium by supporting the back face of said piece of printing medium; and a plurality of ribs extending from said planar portion in a direction parallel to said printing medium path for guiding and supporting said piece of printing medium.

7. The ink jet printer of claim 6 wherein each of said plurality of ribs is substantially trapezoidal in shape when viewed in cross section taken in a direction parallel to the printing medium path.

8. The ink jet printer of claim 6 wherein said ink jet head can eject a plurality of colors to perform a color print operation.

9. The ink jet printer of claim 6 wherein said piece of printing medium is a sheet of paper.

10. An ink jet printer for imprinting on a piece of printing medium having front and back faces, comprising:

a supply roller for supplying said piece of printing medium;

at least two pair of conveying rollers for conveying said piece of printing medium from said supply roller, said at least two pair of conveying rollers being in pressing contact at a contact position;

an ink jet head disposed between said supply roller and said at least two pair of conveying rollers for ejecting ink onto said piece of printing medium during a print operation; and at least one intermediate roller positioned and arranged so as to urge the piece of printing medium to a position lower than said contact position of said at least two pair of conveying rollers when the piece of printing medium contacts said at least one intermediate roller.

11. The ink jet printer of claim 10, wherein said at least two pairs of conveying rollers are disposed across a printing medium path, each pair of rollers being in pressing contact at a contact position and being spaced apart from an adjacent pair of conveying rollers disposed across said printing medium path, and wherein said at least one intermediate roller is further positioned and arranged between adjacent pairs of conveying rollers.

12. The ink jet printer of claim 11, wherein each of said at least one intermediate roller is spaced sufficiently from said adjacent pair of conveying rollers to allow said piece of printing medium to sag in a region therebetween.

13. The ink jet printer of claim 10, further comprising a gap defining member disposed between said supply roller and said conveying roller for defining a gap between said ink jet head and the piece of printing medium by supporting the back face of the piece of printing medium.

14. The ink jet printer of claim 13, wherein said at least one intermediate roller contacts said piece of printing medium at a position lower than said contact position of said at least two pairs of conveying rollers.

15. The ink jet printer of claim 13, wherein each of said at least one intermediate rollers is supported by an elastic member so as to cause said at least one intermediate roller to urge said piece of printing medium away from said ink jet head when said at least one intermediate rollers contacts said piece of printing medium.

16. The ink jet printer of claim 13, wherein said gap defining member further comprises a plurality of ribs extending in a direction parallel to a printing medium path.

17. The ink jet printer of claim 16, wherein each of said plurality of ribs is substantially trapezoidal in shape.

18. The ink jet printer of claim 16, further comprising guide portions disposed downstream in said printing medium path from said gap defining member and upstream in the printing medium path from said at least two pair of conveying rollers for guiding a front edge of said piece of printing medium toward said at least two pair of conveying rollers.

19. The ink jet printer of claim 18, wherein said guide portions include a top face and a front face and said front face is disposed in opposition to said contact position of each of said at least two pair of conveying rollers.

20. The ink jet printer of claim 10, wherein said ink jet head ejects a plurality of colors to perform a color print operation.

21. The ink jet printer of claim 10 wherein said piece of printing medium is a sheet of paper.

22. An ink jet printer for imprinting on a piece of printing medium having front and back faces, comprising:

a supply roller for supplying said piece of printing medium;

at least two pair of conveying rollers for conveying said piece of printing medium from said supply roller, said at least two pair of conveying rollers being in pressing contact at a contact position;

an ink jet head disposed between said supply roller and said at least two pair of conveying rollers for ejecting ink onto said piece of printing medium during a print operation; and a discharge tray disposed adjacent to said at least two pair of conveying rollers for receiving said piece of printing medium conveyed by said at least two pair of conveying rollers, said discharge tray intersecting said printing medium path at an inclined angle.

23. An ink jet printer for imprinting a piece of printing medium having front and back faces, comprising:

a supply roller for supplying said piece of printing medium along a printing medium path;

at least two pair of conveying rollers for conveying said piece of printing medium from said supply roller disposed across a printing medium path, each pair of conveying rollers being in pressing contact at a contact position and being spaced apart from an adjacent pair of conveying rollers disposed across said printing medium path;

an ink jet head disposed between said sheet supply roller and said at least two pair of conveying rollers for ejecting ink onto said piece of printing medium during a print operation;

a gap defining member disposed in opposition to said ink jet head for defining a gap between said ink jet head and said piece of printing medium, comprising a plurality of ribs extending in a direction parallel to said printing medium path for guiding said piece of printing medium, said ribs facing said ink jet head for defining the gap between said ink jet head and said piece of printing medium by supporting the back face of said sheet of paper; and at least one intermediate roller positioned and arranged so as to urge the piece of printing medium to a position lower than said contact position of said at least two pair of conveying rollers when the piece of printing medium contacts said at least one intermediate roller.

24. The ink jet printer of claim 23, wherein said at least one intermediate roller contacts said piece of printing medium at a position lower than said contact position of said at least two pairs of conveying rollers.

25. The ink jet head of claim 23, wherein each of said at least one intermediate roller is supported by an elastic member so as to cause each of said at least one intermediate roller to urge said piece of printing medium away from said ink jet head when said at least one intermediate roller contacts said piece of printing medium.

26. The ink jet printer of claim 23 wherein at least one intermediate serrated roller is spaced sufficiently from said adjacent pair of conveying rollers to allow said piece of printing medium to sag in a region therebetween.

27. The ink jet printer of claim 23, wherein each of said plurality of ribs is substantially trapezoidal in shape.

28. The ink jet printer of claim 27, further comprising guide portions disposed downstream in a printing medium path from said gap defining member and upstream in the printing medium path from said at least two pairs of conveying rollers for guiding a front edge of said piece of printing medium toward said at least two pairs of conveying rollers.

29. The ink jet printer of claim 28 wherein said guide portions include a top face and a front face and said front face is disposed in opposition to said contact position of each of said at least two pair of conveying rollers.

30. The ink jet printer of claim 23, further comprising a discharge tray disposed adjacent to said at least two pair of conveying rollers for receiving said piece of printing medium conveyed by said at least two pair of conveying rollers, said discharge tray intersecting said printing medium path at an inclined angle.

31. The ink jet printer of claim 23, wherein said ink jet head ejects a plurality of colors to perform a color print operation.

32. The ink jet printer of claim 23 wherein said piece of printing medium is a sheet of paper.

* * * * *